United States Patent [19]

Hunt et al.

[11] Patent Number: 4,506,881

[45] Date of Patent: Mar. 26, 1985

[54] DUPLEXING PAPER HANDLING SYSTEM

[75] Inventors: Ronald E. Hunt, Georgetown; William M. Jenkins, Austin, both of Tex.

[73] Assignee: International Business Machines Corporation, Armonk, N.Y.

[21] Appl. No.: 451,704

[22] Filed: Dec. 20, 1982

[51] Int. Cl.[3] ..... B65H 5/06

[52] U.S. Cl. ..... 271/277; 271/3.1; 271/4; 271/65; 271/225

[58] Field of Search ..... 271/3, 3.1, 4, 65, 225, 271/275, 276, 277, DIG. 9; 355/3 SH, 14 SH; 400/624, 625, 629; 346/138

[56] References Cited

U.S. PATENT DOCUMENTS

| | | | |
|---|---|---|---|
| 2,783,048 | 2/1957 | Roberts | 274/4 |
| 2,906,586 | 9/1959 | Collier | 346/138 |
| 3,789,426 | 1/1974 | Farlow | 346/138 |
| 3,893,453 | 7/1975 | Goldberg et al. | 128/2.06 G |
| 3,906,512 | 9/1975 | Farlow | 346/138 |
| 3,955,663 | 5/1976 | Ecker | 197/127 R |
| 4,030,588 | 6/1977 | Hanagata et al. | 197/1 R |
| 4,050,805 | 9/1977 | Hage | 355/14 SH |
| 4,123,182 | 10/1978 | Kondur, Jr. | 400/328 |
| 4,166,614 | 9/1979 | Hamlin et al. | 271/3.1 |
| 4,179,118 | 12/1979 | Huss | 271/277 |
| 4,186,662 | 2/1980 | Borneman | 271/DIG. 9 |
| 4,241,405 | 12/1980 | Allocca | 364/466 |
| 4,411,517 | 10/1983 | Gerken | 271/3.1 |

*Primary Examiner*—George E. A. Halvosa
*Assistant Examiner*—James E. Barlow
*Attorney, Agent, or Firm*—Douglas H. Lefeve

[57] ABSTRACT

An automatic paper handling system capable of loading individual sheets of a stack of paper onto a drum for printing or scanning, escaping a printing or scanning transducer relative to the drum, and stacking the sheet of paper after printing or scanning is additionally provided with duplexing capability to print or scan on the opposite side of a page of paper previously mounted to the drum without the requirement for manual reloading of the page by an operation. During unloading of the page after printing or scanning on a first side thereof a deflector path is interposed in the paper unloading path to cause the trailing edge of the paper during unloading to become the leading edge of the paper for a succeeding loading operation such that the side of the paper previously in contact with the drum will become the side of the paper exposed to the printing or scanning transducer.

6 Claims, 12 Drawing Figures

FIG. 5
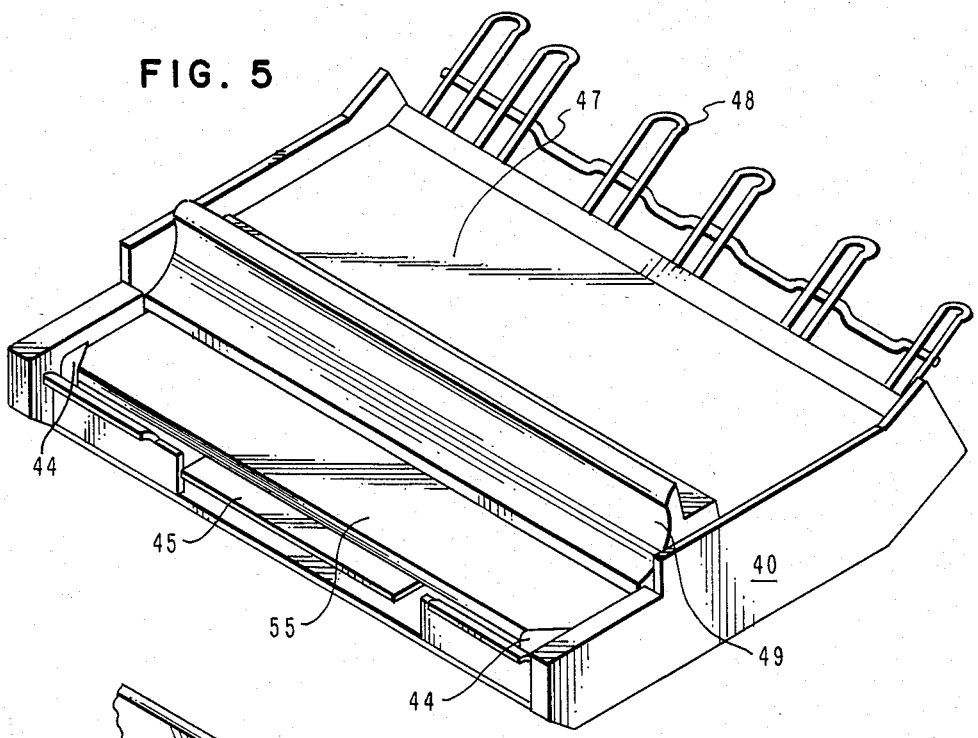
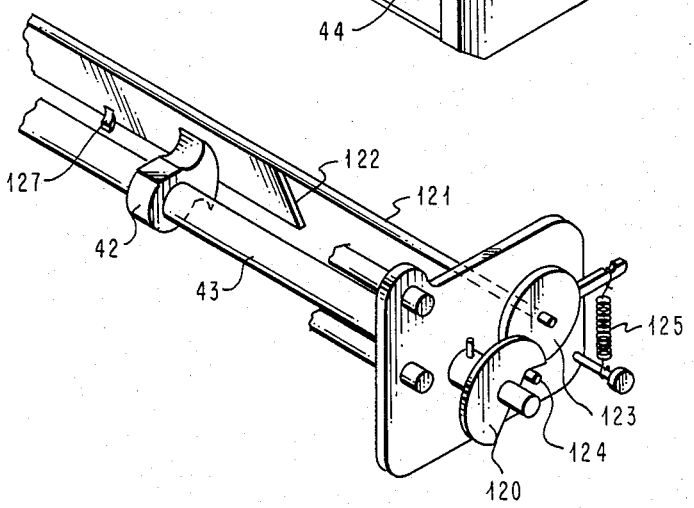
FIG. 10

DUPLEXING PAPER HANDLING SYSTEM

CROSS-REFERNCCE TO RELATED APPLICATION

U.S. patent application Ser. No. 451,650 to R. E. Hunt, filed Dec. 20, 1982, entitled "Paper Handling System" and assigned to the assignee of this invention.

TECHNICAL FIELD

This invention relates generally to paper handling systems and more particularly to a paper handling system in which the movement of a printing or scanning carrier is coordinated with the rotation of a document holding rotatable drum.

BACKGROUND ART (PRIOR ART STATEMENT)

Representative of the closest known prior art are: U.S. Pat. No. 3,893,453 to H. E. Goldberg, et al, filed Feb. 11, 1974, issued July 8, 1975, entitled "Compressed Data Display System"; U.S. Pat. No. 3,789,426 to J. M. Farlow, filed Dec. 29, 1972, issued Jan. 29, 1974, entitled "Facsimile Drive Apparatus"; U.S. Pat. No. 4,179,118 to C. P. Huss, filed Sept. 8, 1977, issued Dec. 18, 1979, entitled "Apparatus And Method For Releasably Securing Sheet Material To The Drum Of A Drum-Type Facsimile Machine"; U.S. Pat. No. 3,906,512 to J. M. Farlow, original filed Dec. 29, 1972, issued Sept. 16, 1975, entitled "Mechanical Drum Positioning And Sheet-Clamping Mechanism For Facsimile"; U.S. Pat. No. 2,906,586 to D. W. Collier, filed Jan. 7, 1955, issued Sept. 29, 1959, entitled "Sheet Record Machine"; U.S. Pat. No. 2,783,048 to B. Roberts, original filed Apr. 10, 1947, issued Feb. 26, 1957, entitled "Magnetic Recording System". Other patents considered relative to the present invention are: U.S. Pat. Nos. 4,241,405 to M. A. Allocca, filed Aug. 7, 1978,issued Dec. 23, 1980,, entitled "Database Updating Apparatus"; U.S. Pat. No. 4,123,182 to N. Kondur, Jr., filed May 17, 1976, issued Oct. 31, 1978, entitled "Cam Drive For Matrix Print Heads And The Like"; and U.S. Pat. No. 3,955,663 to M. E. Ecker, filed Dec. 23, 1974, issued May 11, 1976, entitled "Incremental Advance Mechanism".

The advent of low cost home computers, small office computers and word processing equipment has led to a great deal of interest in decreasing the size and cost and increasing the functions of printers used as output devices for these data processing and office products. There has also been a requirement for scanning devices such as those used in facsimile systems to encode for storage or communicate previously noncoded information derived from existing documents.

For both the printer and scanner environments some type of automatic paper handling capability greatly increases the function of this equipment. Further, any increase in speed that is possible as a result of a particular design inherently increases the function of the input or output device.

With regard to the technology of supporting a document for the printing or scanning operation, itself, the drum-type paper retaining approach shown in U.S. Pat. No. 3,893,453 is an attractive approach in view of the economy offered by providing drum rotation and a lead screw driven lateral translation carrier from a single motor. No means are shown in this patent, however, relative to any automatic loading or unloading of the paper. U.S. Pat. No. 3,789,426 is another example of a drum-type scanning apparatus. U.S. Pat. Nos. 4,179,118 and 3,906,512 show two types of remotely actuated paper clamps that may be used in conjunction with drum-type document retaining devices. U.S. Pat. No. 2,783,048 shows a dictating machine in which a flexible magnetic recording rectangular sheet is secured to the drum by an adhesive strip on the sheet. U.S. Pat. No. 2,906,586 also shows a dictating machine using a magnetic recording sheet. In neither of these machines using magnetic recording sheets is there shown a mechanism for feeding each of a stack of recording sheets, documents, or other information handling media onto and off of a drum-type document handling apparatus in a one-at-a-time succession. (In addition to the patents discussed above, U.S. Pat. Nos. 3,955,663, 4,241,405, 4,123,182 were considered relative to this invention but were not felt to be at all pertinent to the invention as claimed.)

Another aspect of paper handling that adds significant function to any paper handling system is the ability to handle the document within the system so that operations such as printing or scanning can be performed on both sides of the document. This feature is known in the paper handling art as duplexing, and in a printing system duplexing allows a sheet of paper to be printed upon on both sides.

It would, therefore, be highly advantageous to provide a duplexing function as an enhancement to an efficient paper handling system without adding significantly to the cost or complexity of the system.

DISCLOSURE OF THE INVENTION

Accordingly, a highly efficient and economical paper handling system is provided comprising a cartridge for retaining a stack of paper sheets to be loaded, one-at-a-time, onto a rotatable drum for printing or scanning. Feed rollers are provided for loading the top sheet of paper out of the cartridge past corner buckling retainers and into engagement with a plurality of paper clamps on the drum. When loaded onto the drum the paper is skewed relative to the longitudinal axis of the drum. During rotation of the drum with the paper retained thereon a carrier having a print head or optical scanning transducer moves continuously from one end of the drum toward the other end of the drum in a plane substantially parallel to the axis of the drum. The axial movement of the carrier relative to the drum rotation is timed such that in each rotation of the drum the carrier has escaped a distance equal to the desired distance between printed lines of text. Thus, in this example, when the paper handling system of this invention is used to provide movement of paper for printing the system is capable of printing a plurality of lines of text parallel to each other and also parallel to a pair of opposite edges of a rectangular sheet of paper. In either a printing or scanning environment it is possible to provide a print head or scanning head having the ability to print or scan a wide enough band in each rotation of the drum such that all points on the page are addressable. In the preferred embodiment a lead screw which provides escapement of the carrier is belt or gear driven from the drum so that a single motor can drive both the carrier and the drum.

After a printing or scanning operation has taken place relative to the paper clamped to the drum, the system is cycled to feed the paper off of the drum into engagement with a plurality of pairs of exit rollers which pull the paper out of the clamps on the drum and transport the paper to a stacking area built into the paper cartridge. A duplexing deflector is interjected into the paper path during exit of the paper from the drum to cuase the paper to be reloaded onto the drum on its other side rather than being transported to the stacking area of the paper cartridge. In this manner, duplexing is provided at the expense of very few additional parts.

The foregoing and other objects, features, extensions, and advantages of the invention will be apparent from the following more particular description of preferred embodiments of the invention, as illustrated in the accompanying drawing.

BRIEF DESCRIPTION OF DRAWINGS

FIG. 5 shows the paper cartridge used with the paper handling system of this invention.

FIG. 10 is a view of the paper aligning gate actuation mechanism of the paper handling system of this invention.

BEST MODES FOR CARRYING OUT THE INVENTION

Figure 1:
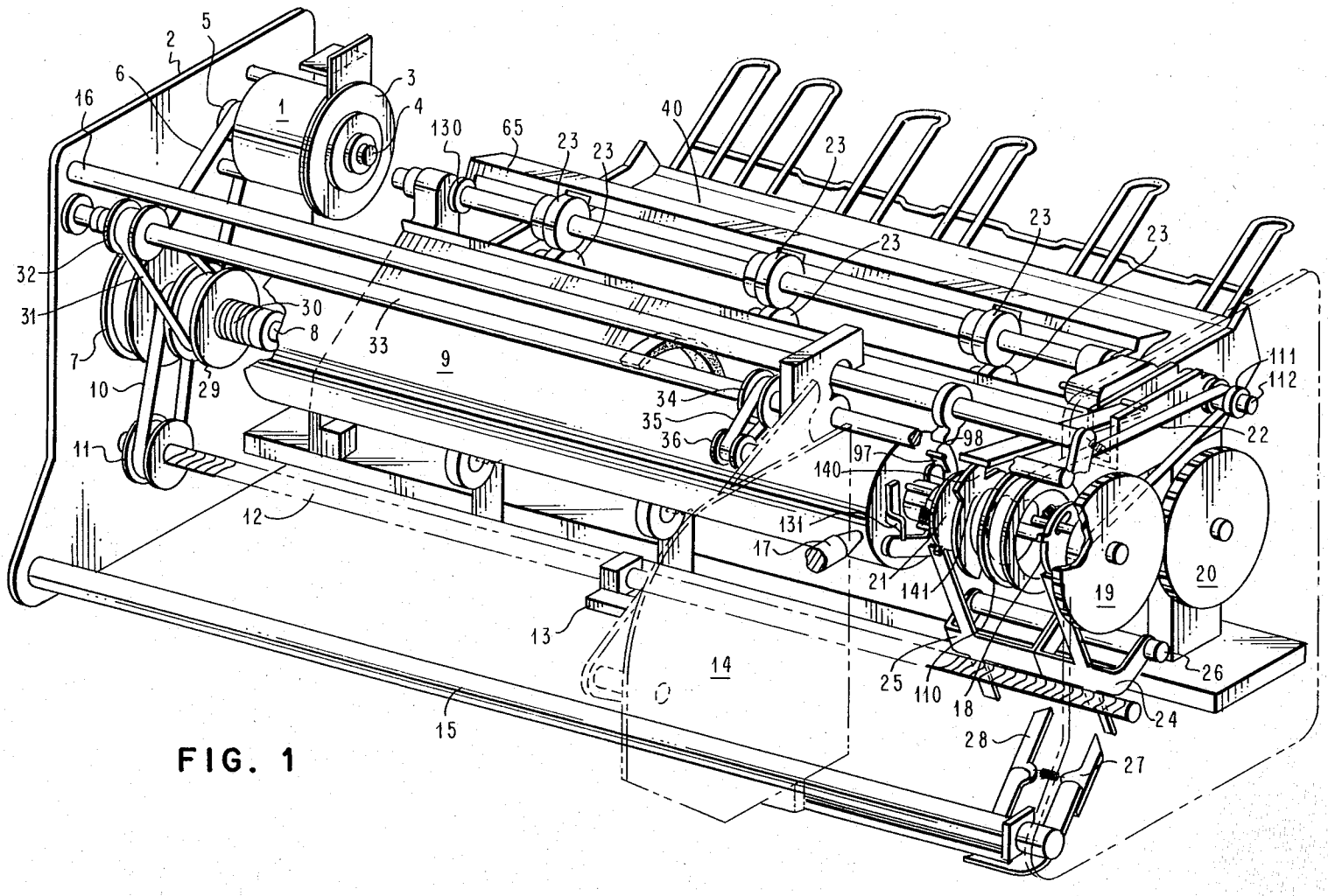
FIG. 1 is a front perspective view of the paper handling system of this invention.

Referring now to FIG. 1 a front perspective view of the paper handling system of this invention is shown. A motor 1 capable of electronic control for operation at various speeds in both directions, such as a D.C. motor, is rigidly mounted to a left frame plate 2. A motor shaft position sensing assembly 3, such as a capacitive angular position sensing transducer, is mounted on one end of motor 1 to deliver to a system of control electronics (not shown) accurate information relative to the angular position and number of turns of the shaft 4 of motor 1. At the other end of the shaft of motor 1 is a motor drive pulley 5 which, in the preferred embodiment, has timing teeth to drive a timing belt 6 with no slippage. Throughout the remainder of the description of this invention all belts and pulleys have timing teeth and it will be assumed that no slippage occurs relative to the belts and pulleys.

Belt 6 drives a document drum drive pulley 7. Pulley 7 is pinned to a document drum drive shaft 8, and shaft 8 is pinned to a document drum 9 so that any angular movement of motor shaft 4 causes corresponding angular movement, according to the ratio of the diameters of pulleys 5 and 7, of drum 9.

Also pinned to shaft 8 is a carrier lead screw pulley (not shown) which drives carrier lead screw belt 10 and carrier lead screw pulley 11. A carrier lead screw 12 is pinned to pulley 11 so that any angular movement of motor shaft 4 causes angular movement of lead screw 12 according to the ratios of the diameters of the two pairs of pulleys between motor shaft 4 and lead screw 12.

A lead screw follower 13 is associated with the lead screw 12 to move left or right according to the rotation of lead screw 12. Lead screw follower 13 is rigidly attached to a printing or scanning carrier 14 to provide left or right movement of carrier 14 along frame rails 15 and 16 in accordance with lead screw motion.

When the paper handling system of this invention is used to provide paper handling and motion for printing operations, carrier 14 has mounted thereon a printing transducer 17 which may be selected from a number of printing technologies. Such printing technologies may include, but are not limited to, drop-on-demand ink jet printing, wire matrix printing, resistive ribbon printing, and thermal printing. If the paper handling system of this invention is used in an image scanning system to scan and digitally encode previously generated images, an appropriate light source and light sensitive detector assembly would be mounted on carrier 14 for translation relative to an intelligence bearing document mounted on drum 9. It will be understood by those skilled in the art that the choice of appropriate printing or scanning transducers is not a part of the paper handling system of this invention.

A load dog clutch assembly 18 mounted concentric with and near the right end of drum shaft 8 is engageable with shaft 8 to turn gears 19 and 20 which rotate drive rollers to drive a sheet of paper into this paper handling system to be loaded onto drum 9, as will be explained in detail hereinafter. An exit dog clutch assembly 21 is mounted concentric with shaft 8 just to the left of dog clutch assembly 18. The dog clutch assembly 21 is intermittently engaged relative to shaft 8 to drive belt 22 which turns paper exit rollers 23 for driving paper out of the system from drum 9, as will be explained in detail hereinafter.

With respect to both of the dog clutches 18 and 21, the details of which will be understood by those skilled in the art, the clutches are engageable to turn gear 19 and to drive belt 18, respectively, one revolution after having been tripped and during counterclockwise rotation of shaft 8 relative to the right end of FIG. 1. Shaft 8 has mounted thereon single dog teeth associated with each of dog clutches 18 and 21.

A load clutch latch lever 24 associated with dog clutch assembly 18 and an exit clutch latch lever 25 associated with dog clutch assembly 21 are separately pivotable about a shaft 26. Latch levers 24 and 25 are engaged and tripped by load clutch trip lever 27 and exit clutch trip lever 28, as will be described in more detail hereinafter. Trip levers 27 and 28 are mounted for movement along with movement of carrier 14.

A pulley 29 is selectively engageable to shaft 8 through a spring clutch 30. The application of a radial force to the outside of spring clutch 30 toward the center of shaft 8 causes engagement of spring clutch 30 which drives pulley 29, belt 31, and pulley 32. A rotatable auxiliary shaft 33 is pinned to pulley 32. Pulley 34 is axially slidable along auxiliary shaft 33 but is angularly keyed to shaft 33. Thus, engagement of spring clutch 30 during rotation of shaft 8 causes rotation of shaft 33, pulley 34, belt 35, and pulley 36. Pulley 36 has an axle (not shown) on carrier 14 and may be used to selectively impart rotational motion to carrier 14 for an auxiliary operation, for example escapement of an inked printing ribbon. A lever connected to a solenoid (not shown) may be used to selectively engage clutch 30.

Also shown in FIG. 1 is a partial view of a paper cartridge 40 which is shown and described in greater detail hereinafter.

Figure 2:
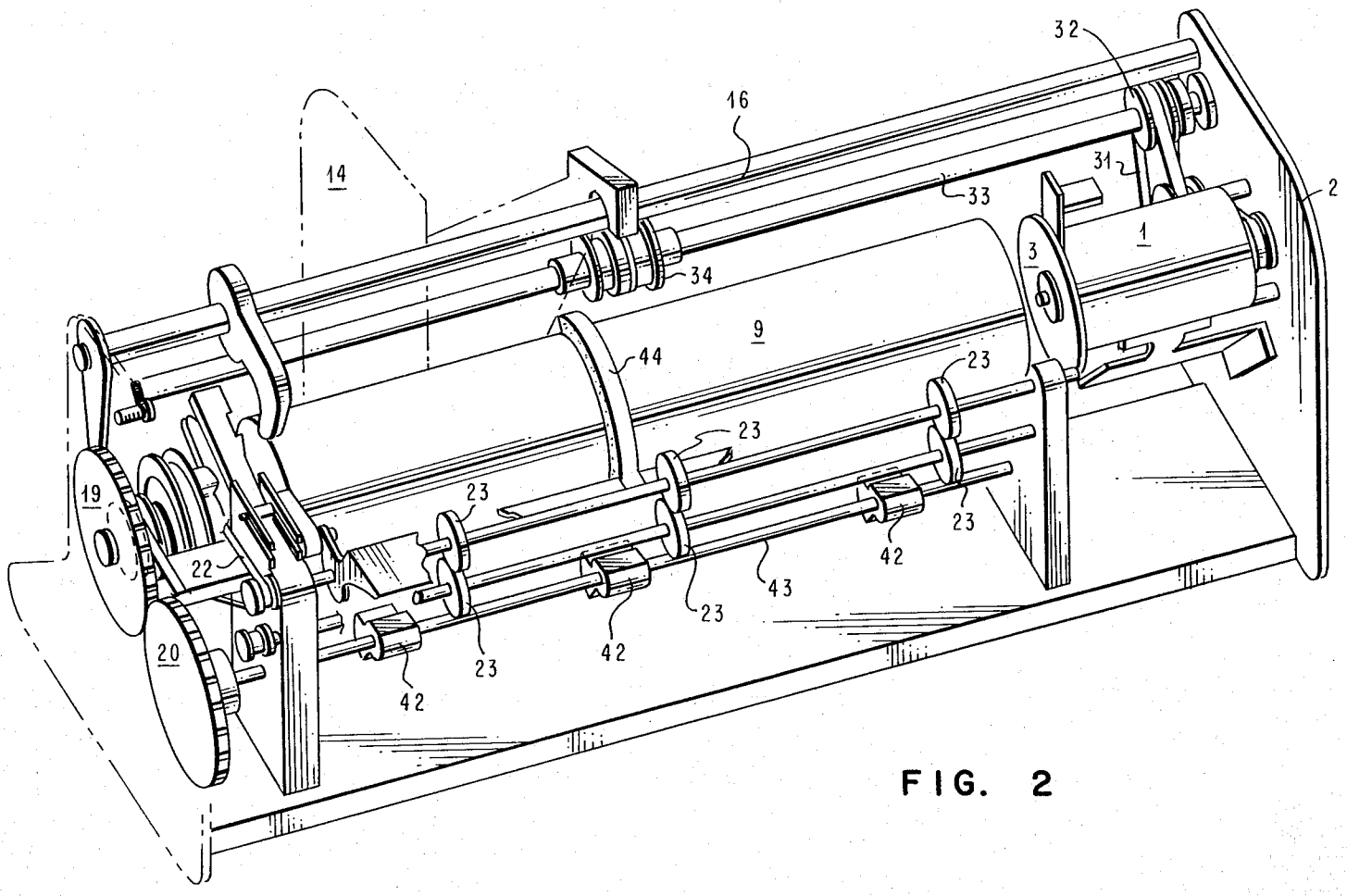
FIG. 2 is a rear perspective view of the paper handling system of this invention.

The rear perspective view of the paper handling system of this invention shown in FIG. 2 shows many of the aforementioned components of the system as were described relative to FIG. 1. For the purpose of clarity the same reference numerals are used for the elements described relative to FIG. 1.

In FIG. 2 a set of feed rollers 42 are shown which are pinned to a feed roller shaft 43. The feed roller shaft 43 is pinned to gear 20 so that rotation of rollers 42 occurs during the time of engagement of the load clutch 18, FIG. 1. A paper guide 44 is shown in FIG. 2, spaced from drum 9 by a suitable gap to maintain a document loaded onto drum 9 substantially in contact with the drum during the arc of the rotation enclosed by guide 44.

Figure 4:
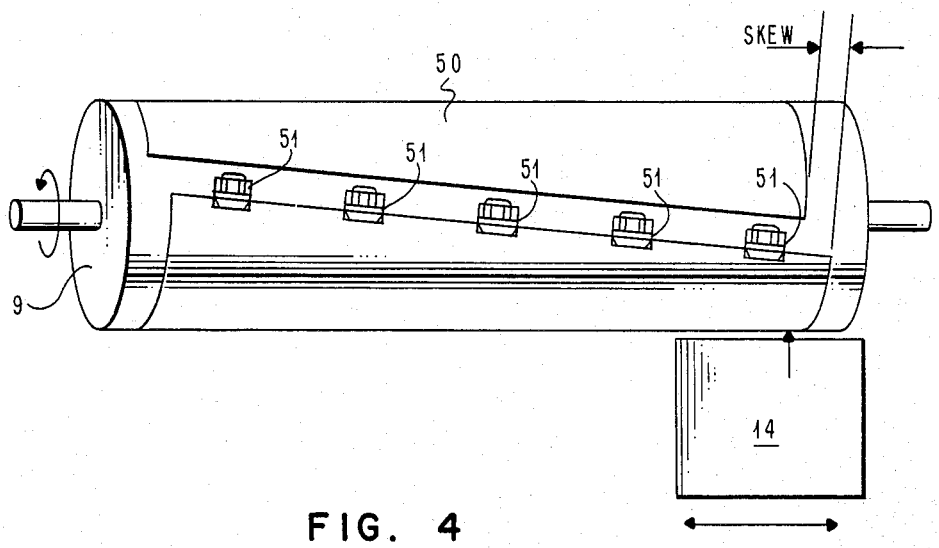
FIG. 4 is a view of the drum and a sheet of paper clamped thereon showing the skewed orientation of the paper relative to the drum.

Referring now to FIG. 4 a sheet of paper 50 is shown clamped onto drum 9 by a plurality of spring loaded clamps 51. In their normal position, clamps 51 hold an edge of paper 50 onto the surface of drum 9. Clamps 51 may be simultaneously opened by rotation of a torque bar which runs the length of drum 9, inside the drum. An end of the torque bar is shown in FIG. 1 and is denoted by reference numberal 97.

At the appropriate time in each paper loading cycle an actuation mechanism which will be described in more detail hereinafter is moved by a pin extending from gear 19 to engage the torque bar 52 to rotate and provide for momentary opening of clamps 51.

FIG. 4 shows, in an exaggerated manner, the skewed relationship of the edges of the rectangular sheet of paper 50 relative to the axis of drum 9. Carrier 14 is also shown schematically to be representative of any choice of printing or scanning technology.

FIG. 5 shows a more detailed view of the paper cartridge 40. Cartridge 40 is known in the paper handling art as a "corner buckling" cartridge in view of the paper corner retaining clips 44 which normally retain the paper in the cartridge. A spring loaded plate 45 upwardly biases the stack of papers 55. Clockwise engagement of feed rollers 42, FIG. 2, with the top sheet of papers 55 cause the exposed edge of the top sheet of sheets 55 to buckle upwardly as the sheet is driven out of the cartridge until the two corners release themselves from the retaining clips 44. After these corners are released the top sheet can continue to be fed onto drum 9 by further movement of feed rollers 42. Cartridge 40 also includes a paper stacking tray 47 and associated paper stacking extension rack 48 on which sheets of paper are supported after they are exited from the printing or scanning operation that occurs while the paper is clamped on drum 9. Finally, cartridge 40 includes a duplex path 49 which will be described in more detail hereinafter in accordance with the description of the duplex feature of this invention.

Figure 3:
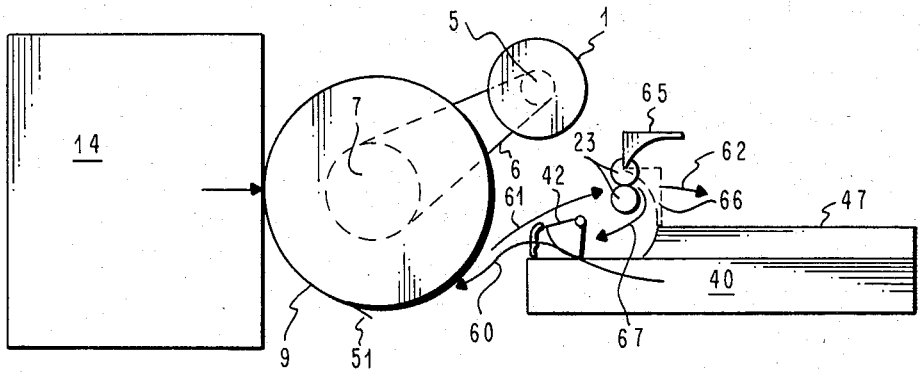
FIG. 3 is a side view of a portion of the paper handling system of this invention which shows the paper path during loading and exiting of paper onto and off of the drum.

Referring now to FIGS. 1, 2, and 3 the paper handling paths of the system are described. Looking from the right end of the drum back toward the left, counterclockwise rotation of drum 9 causes the print carrier 14 to traverse toward its rightmost limit. Just before it reaches its rightmost limit feed rollers 42 are engaged to rotate one revolution in a clockwise direction. This drives the top sheet of paper in cartridge 40 out of cartridge 40 toward the drum as indicated by arrow 60. At this time, paper clamps 51 and the leading edge of the paper (not shown) being driven out of cartridge 40 are converging. At this convergence paper clamps 51 are opened against their normally self-closing spring tension. When this convergence has continued to the point that the leading edge of the paper is positioned underneath the opened leading edges of paper clamps 51, rotation of drum 9 is reversed into a clockwise direction. Paper clamps 51 close upon this reversal and the paper is now engaged by paper clamps 51 to be wrapped around drum 9 and rotate in a clockwise direction as viewed from the nearest end of drum 9 shown in FIGS. 1–3. During clockwise rotation of drum 9 carrier 14 traverses to the left, when viewed from FIG. 1, and away from the viewer with respect to FIGS. 2 and 3.

When these printing or scanning operations have been completed relative to the sheet of paper (not shown) mounted on drum 9, the direction of rotation of drum 9 is again reversed into the counterclockwise direction. This moves the trailing edge of the paper in the direction indicated by arrow 61, FIG. 3. Eventually this trailing edge of paper is engaged by the pairs of exit rollers 23 which rotate at a speed slightly faster than the surface linear velocity ofdrum 9. This speed differential causes the paper to be pulled out of clamps 51 without necessitating the reopening of clamps 51 by their opening mechanism. The paper continues to be moved through exit rollers 23 in the direction indicated by arrows 62 until the paper is stacked on the stacking tray 47 of cartridge 40.

Duplexing of paper, such that a page exiting drum 9 is caused to be reloaded onto drum 9 on the opposite side of the paper, is accomplished in accordance with the preceding description relative to the removal of a page from drum 9. When duplexing is desired, however, the duplexing deflector 65 is rotated about one-fourth of a revolution in the clockwise direction as shown in FIG. 3 by the dashed outlined duplexing deflector denoted by reference numeral 66. As the edge of the page exiting drum 9 that is not clamped by clamps 51 engages the exit rollers 23, the duplexing deflector, positioned in accordance with reference numeral 66, prevents the this edge of the paper from traveling out onto the stacking area 47 of cartridge 40. Instead, the this edge of the paper is curved in a clockwise direction toward feed rollers 42 as indicated by arrows 67. With proper timing, feed rollers 42 engage the previously trailing edge of the paper and cause it to be loaded back into clamps 51 on drum 9. When this operation has been completed the opposite side of the page previously clamped onto drum 9 is now available to carrier 14 for printing or scanning. It will be noted that this duplexing technique can be utilized in any number of successive operations relative to the same page of paper before the page is ultimately transported to the stacking tray 47 of cartridge 40.

Figure 6:
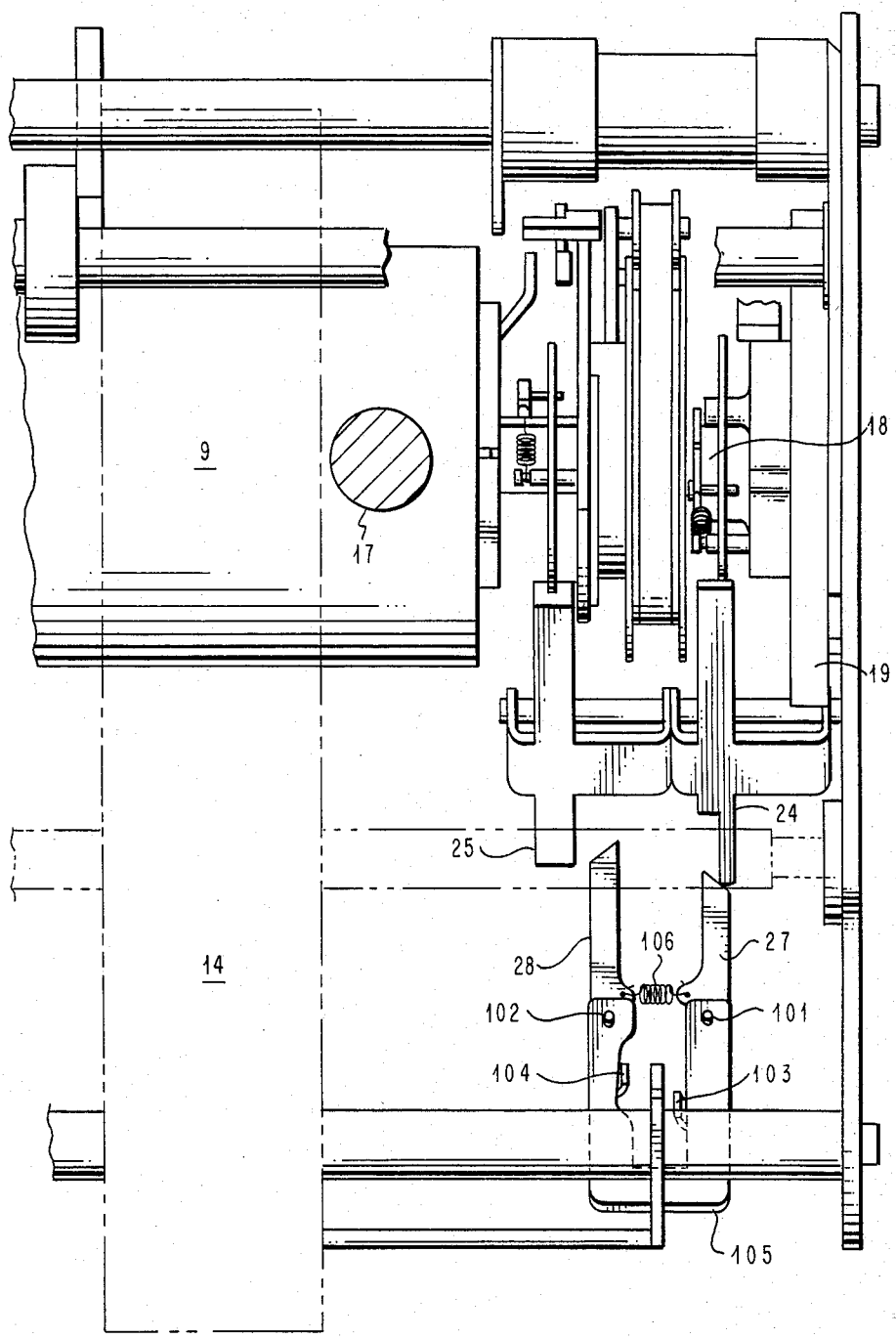
FIGS. 6 and 7 show different positions of the clutch latching mechanisms of the paper handling system of this invention.

For a more particular description of the operation of loading a sheet of paper onto drum 9, refer to FIG. 6 and note the engagement of the ramp end of load clutch trip lever 27 relative to load clutch latch lever 24. A slight bit more rightward movement of carrier 14 and, therefore, trip lever 27 causes enough counterclockwise rotation of load clutch latch lever 25 (as viewed in FIG. 1) to trip the load dog clutch assembly 18.

Figure 8:
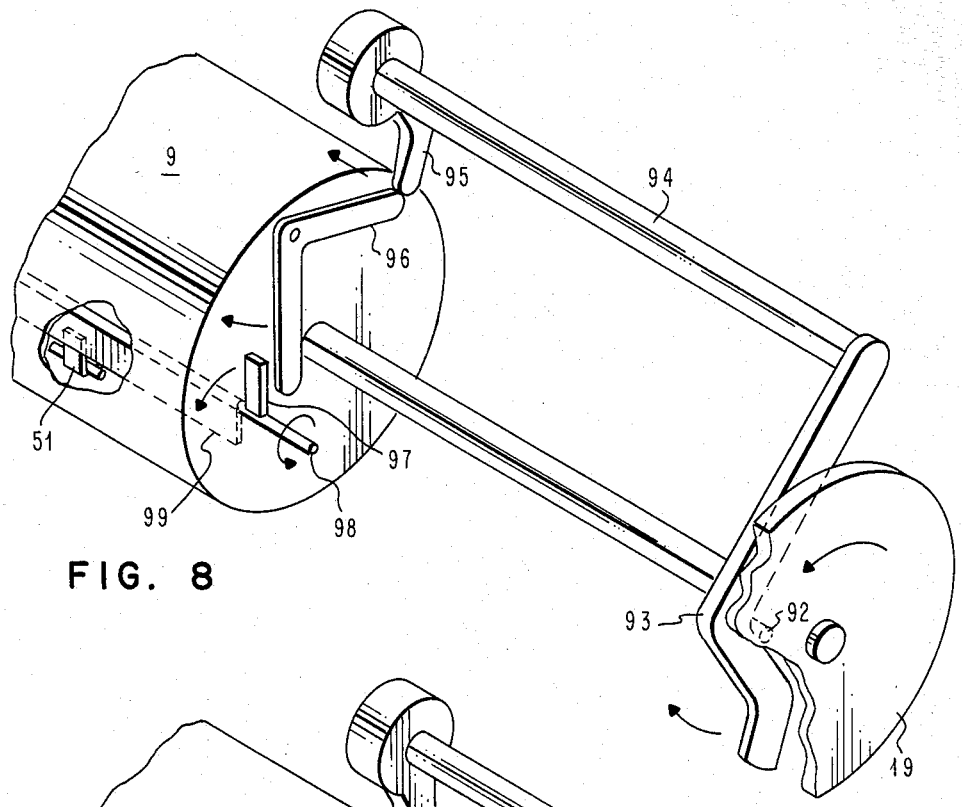
FIGS. 8 and 9 are views of the drum paper clamp opening mechanism in different positions.
Figure 9:
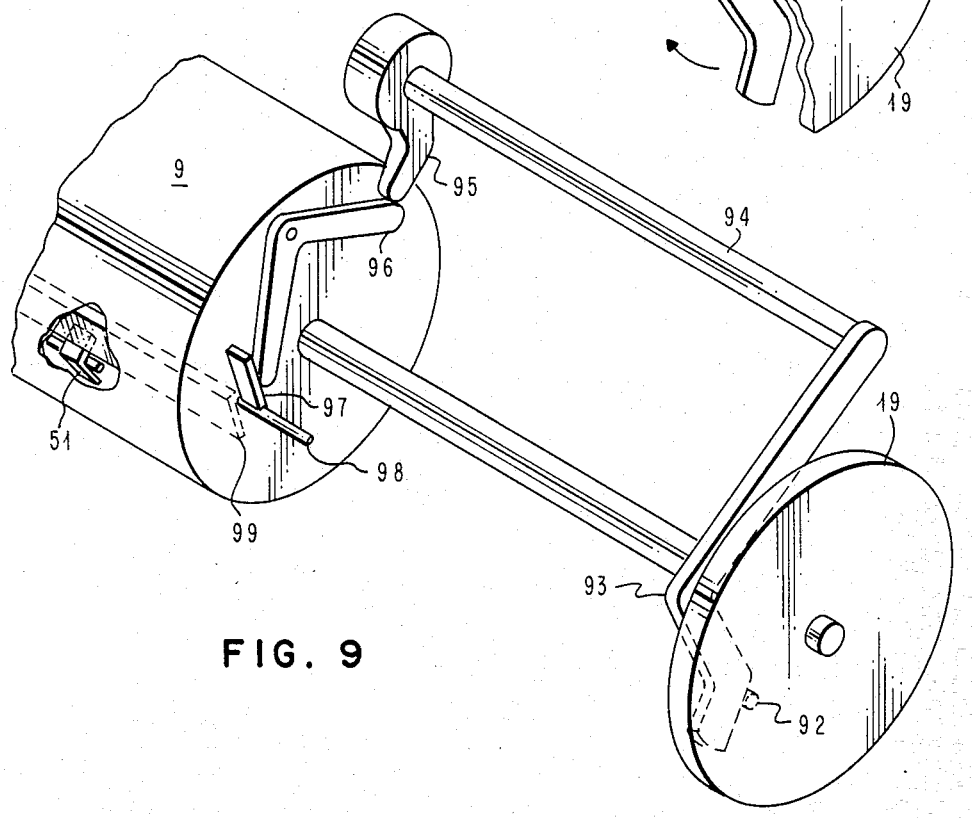

Referring back to FIG. 1, when the load dog clutch 18 has been tripped, the engagement of the single dog tooth in that clutch assembly causes counterclockwise rotation of gear 19 and, therefore, clockwise rotation of gear 20. In FIG. 2 it will be noted that the clockwise rotation of gear 20 provides the clockwise rotation of driver rollers 42 to drive the top page of paper out of cartridge 40 toward the drum 9 as described relative to FIG. 3. Referring to FIGS. 8 and 9, during this counterclockwise rotation of gear 19 and drum 9, a pin 92 on gear 19 engages lever 93. Lever 93 is mounted to shaft 94 and this engagement of pin 92 relative to lever 93 during counterclockwise rotation of gear 19 causes a clockwise rotation of shaft 94. Another lever 95 mounted to shaft 94 can now engage lever 96 which is pivotable relative to the right end of drum 9. The other end of lever 96 from that which engages lever 95 is caused to rotate in a clockwise arc and engages tab 97 on torque bar 98. Torque bar runs the length of drum 9 and has a plate 99 mounted thereto which engages paper clamps 51 to open paper clamps 51 upon counterclockwise rotation of bar 98.

At this time drum 9 has rotated counterclockwise and paper clamps 51 are open. A sheet of paper has been driven by feed rollers 42 far enough to have the leading edge thereof positioned under paper clamps 51. The rotation of drum 9 is now reversed so that drum 9 rotates clockwise as viewed from the right end of FIG. 1. The sheet of paper is now clamped onto drum 9.

Clockwise rotation of drum 9 also reverses the direction of lead screw 12 and causes carrier 14 to traverse toward the left end of the paper handling system shown in FIG. 1. Referring to FIG. 6, during the paper loading operation the assembly of trip levers 27 and 28 have progressed as far right as possible during operation of the paper handling system. At the end of paper loading the left side of trip lever 27 was positioned just to the right of latch lever 24.

It will be noted that both trip levers 27 and 28 are rotatable about pins 101 and 102, respectively. However, tabs 103 and 104 on trip levers 27 and 28, respectively, interfere with the trip lever support 105 such that only clockwise rotation of trip lever 27 is possible and only counterclockwise rotation of trip lever 28 is possible. In the absence of any other forces to rotate trip levers 27 and 28, spring 106 biases both trip levers to the positions shown in FIG. 6.

Figure 7:
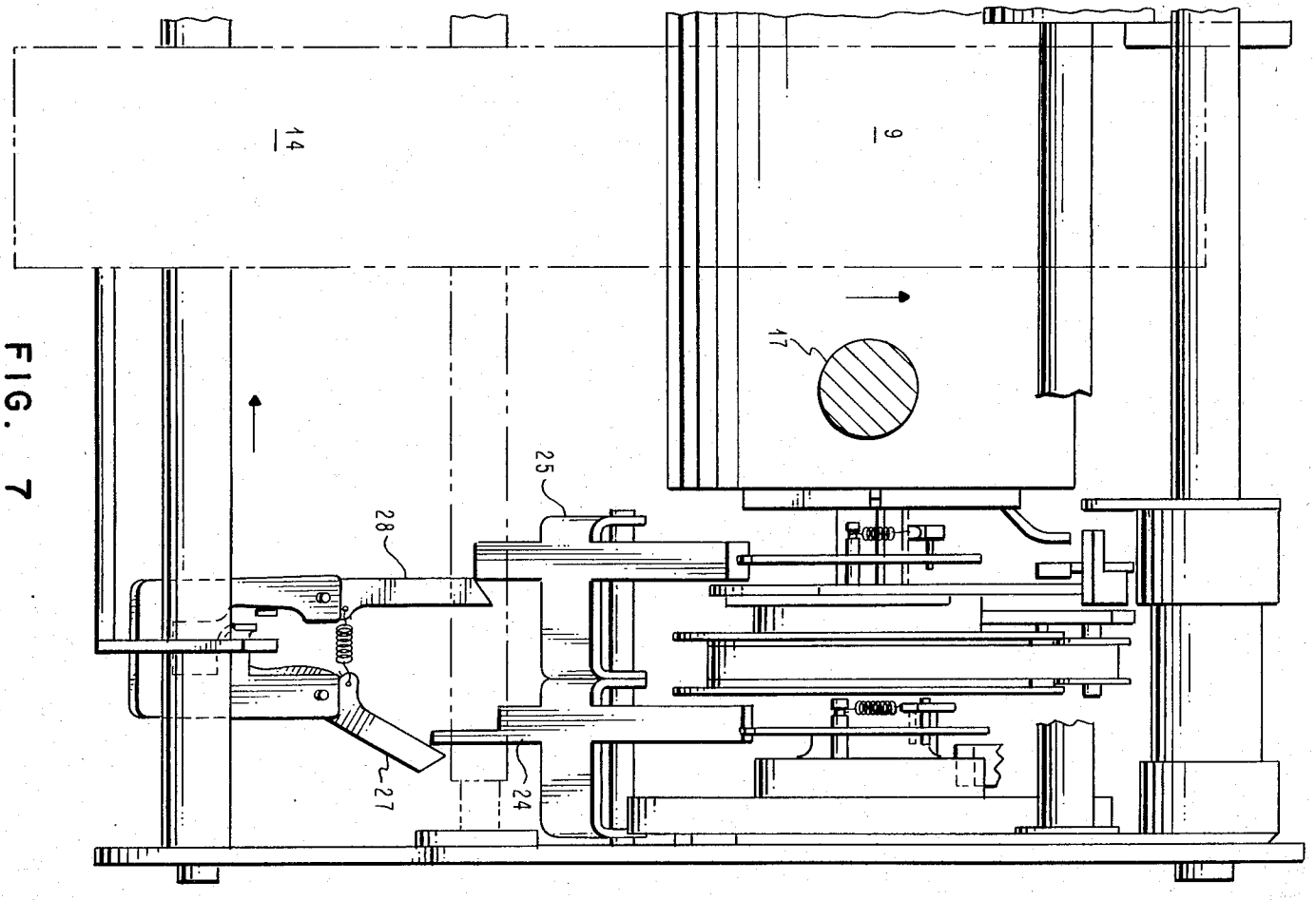

Thus, referring to FIG. 7, trip lever 27 rotates clockwise as it passes the load clutch latch lever 24 and does not trip this latch lever during clockwise rotation of drum 9 with carrier 14 traversing to the left. As the exit clutch trip lever 28 rides into contact with the exit clutch latch lever 25, this exit clutch latch lever is tripped relative to the exit dog clutch 21 to arm clutch 21 for paper unloading when drum rotation reverses again to a counterclockwise direction. However, it will remembered that both of the dog clutches 21 and 18 engage for driving the pulley or gear, respectively, connected thereto only when drum 9 is rotated in a counterclockwise direction and only for one revolution after these clutches have been tripped.

With the paper loaded, the drum rotating clockwise and the exit clutch having been tripped as described above relative to FIG. 7, carrier 14 continues to traverse to the left during which time printing or scanning operations can occur. It will be understood by those skilled in the art that relatively high speed printing or scanning can take place because the drum is rotating continuously, without having to reverse direction, in a high speed manner relative to carrier 14 and the printing or scanning element 17 rigidly attached thereto. Further, in view of the skewed mounting of the sheet of paper on drum 9, the carrier 14 can be continuously indexed with any requirement for movement only between printed lines. Various printing technologies can be employed such as resistive ribbon printing, wire matrix printing, and drop-on-demand ink jet printing, as examples. If it is necessary to provide a means for feeding a ribbon in a printing process, clutch 30 can be engaged to rotate pulley 29 relative to rotation of shaft 8 which, in turn, causes rotation of pulley 32, shaft 33, and pulleys 34. Belt 35 then transfers this rotation to pulley 36 mounted on carrier 14 which can be connected to a ribbon transport mechanism as will be understood by those skilled in the art. Clutch 30 can be an overrunning spring clutch to cause rotation of shaft 33 at any time that shaft 8 and drum 9 are rotated in a clockwise direction. Alternatively, if selective ribbon feed is desired clutch 30 can be a non-overrunning spring clutch selectively activated by an arm connected to an electromagnetic solenoid (not shown).

After the desired printing or scanning operation relative to a first side of the paper mounted on drum 9 has taken place, the paper handling system can be operated to cause the paper document to be removed from drum 9 and stacked on the stacking tray 47 of cartridge 40. An optical sensor (not shown) on carrier 14 senses the passage of the trailing edge of the document mounted on drum 9. Clockwise rotation continues for approximately one-half of a rotation more at which time the direction of drum 9 is reversed for rotation in a counterclockwise direction. This delay in reversing the direction of rotation allows the trailing edge of the paper to be positioned at the lower right quadrant of drum 9 as viewed in FIG. 3 so that counterclockwise rotation of drum 9 allows the trailing edge of the paper to travel in a direction indicated by arrows 61 instead of jamming against other components of the paper handling system when rotation of drum is reversed.

With the counterclockwise rotation of drum 9 for exiting the paper from the drum the exit clutch 21 engages to drive pulley 110 (FIG. 1), belt 22, pulley 111, and exit roller shaft 112 in counterclockwise rotation as viewed from the right end of FIG. 1. Referring to FIGS. 1–3, this rotation of the exit roller shaft 112 causes exit rollers 23 to engage the trailing edge of the paper unwrapping from drum 9 and transports the paper toward the stacking tray 47 of cartridge 40. As described above, the speed ratio of rollers 23 relative to drum 9 is such that rollers 23 pull the paper out of the paper clamps 51 of drum 9 without the necessity of reopening these spring loaded paper clamps for paper removal.

After a page of paper has been exited into the stacking tray as described immediately above, continued counterclockwise rotation of drum 9 eventually causes the load trip lever 27 to trip the load clutch latch lever 24 as described relative to FIG. 6 for loading another sheet of paper from paper cartridge 40 onto drum 9. It will be noted relative to FIG. 6 that on its way to the righthand position shown in FIG. 6 trip lever 28 rotates counterclockwise past the exit clutch latch lever 25 without tripping the latch lever.

It will also be noted that a single priority page of paper can be inserted into the rear of this paper handling system at any time immediately above the top sheet of paper in the cartridge 40 without clamping the leading edges of this page under the corner buckling clamps 44 of cartridge 40. When the next paper loading operation takes place, the page entered in this priority manner will be the page fed to drum 9 rather than the top sheet in the cartridge.

Referring to FIG. 10, at each instance of loading a sheet of paper onto drum 9, with counterclockwise rotation of the feed rollers 42 and shaft 43 (as viewed from this end of shaft 43 in FIG. 10) cam 120, pinned to shaft 43, causes a corresponding counterclockwise rotation in shaft 121 to which is connected a paper aligning gate 122. In FIG. 10, it will be noted that this counterclockwise rotation is caused by the engagement of pin 124 (on bell crank 123) with cam 120 during rotation of shaft 43. Bell crank 123 is pinned to shaft 121 and is normally biased to the position shown in FIG. 10 by spring 125. The initial position of the paper aligning gate 122 is down as shown in FIG. 10 and a plurality of tabs 127 along gate 122 are a gating surface for the front edge of a priority sheet of paper to be loaded. Tabs 127 position the leading edge of a priority sheet over the top sheet of the stack of pages retained in the cartridge 40. However, during paper loading the counterclockwise rotation of shaft 43 and the corresponding counterclockwise rotation of the paper aligning gate 122 (about one-fourth turn) removes the restraint provided by tabs 127 after their gating function has been provided, so that loading of the priority sheet can continued.

Assume now that a page of paper is presently loaded on drum 9 for printing or scanning on a first side of this page of paper. The paper handling system of this invention provides a capability for duplexing this paper. That is, the mechanism is capable of removing the paper from the drum, and reloading it onto the drum so that the side previously in direct contact with the drum is now exposed for printing or scanning. The description of the duplexing operation starts with the assumption that a page of paper has been loaded onto drum 9 and that drum 9 is rotating in a clockwise direction (as viewed from the right end of FIG. 1). It is further assumed that the exit clutch 21 latch lever 25 has been tripped by the exit clutch trip lever 28. The duplexing operation then proceeds initially with the beginning steps of unloading the paper from the drum as described above. However, as soon as the page becomes engaged by all of exit rollers 23 drum rotation is again reversed into a clockwise direction as viewed from the right end of FIG. 1.

In FIG. 1 at the left end of exit roller shaft 112 is an overrunning spring clutch 130 which allows only counterclockwise rotation of shaft 112 as viewed from the right end of FIG. 1. As noted above, neither dog clutch drives during clockwise rotation of drum 9. However, in view of the clutch 130 on exit roller shaft 112, shaft 112 and rollers 23 cannot reverse and freewheel in the opposite direction as drum 9 attempts to pull the page of paper out of these rollers during its clockwise rotation. Thus, exit rollers 23 restrain the paper and with clockwise rotation of drum 9 the page is pulled out of clamps 51.

Figure 11:
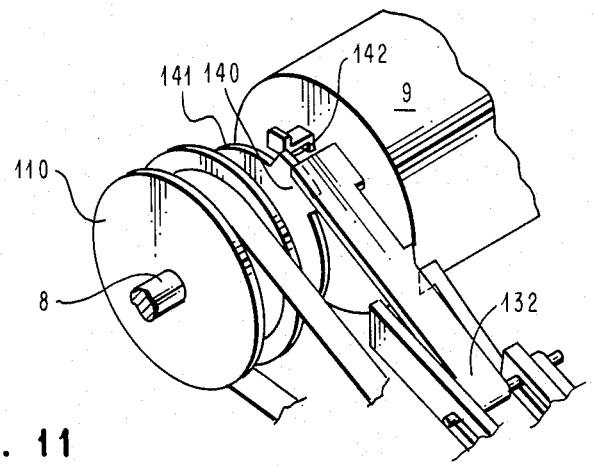
FIGS. 11–12 are views of the duplexing mechanism in different positions of operation.
Figure 12:
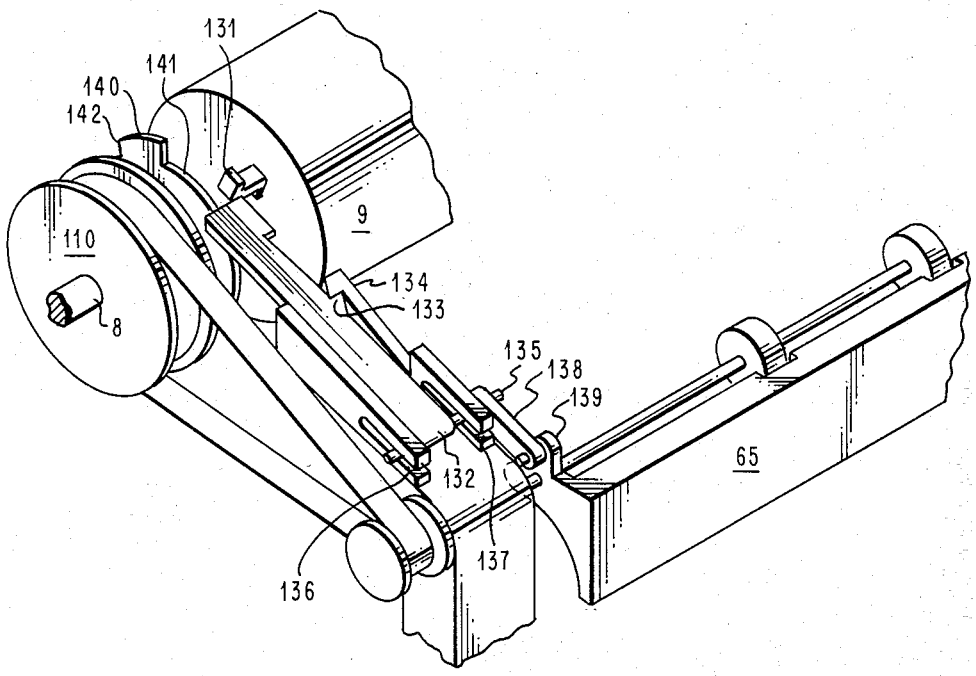

FIGS. 11 and 12 also show the right end of drum 9 and the duplexing mechanism. Referring now to FIG. 12 as drum 9 continues to rotate in a clockwise direction a finger 131 which is rigidly attached to drum 9 engages a duplexing latch arm 132 and pushes this arm toward the right until tooth 133 on arm 132 is latched by a spring latch 134. A pin 135 extending through latch arm 132 and slidable in slots 136 and 137 pushes link 138 connected to a bell crank portion 139 of duplex deflector 65. Referring back to FIG. 3 the operations described cause the approximately one-quarter turn clockwise rotation of duplex deflector 65 down into the position shown by reference numeral 66 in FIG. 3.

As soon as the duplex deflector latching mechanism has been set as just described rotation of drum 9 is reversed again to a counterclockwise rotation. Counterclockwise rotation of drum 9 again causes rotation of the exit rollers 23 to pull the page of paper away from the drum. However, as the page is pulled away from the drum, instead of being driven out onto the stacking area 47 of cartridge 40, the paper is looped down past the duplex path 49 of cartridge 40 and is positioned above the top sheet of paper in cartridge 40. The paper aligning gate 122 in FIG. 10 is in the position shown in FIG. 10 at this time so that the edge of the page first exiting drum 9 can be driven no further forward toward being loaded onto drum 9.

Referring to FIG. 11, during this present counterclockwise rotation of drum 9 a step surface 140 on disk 141 rotating with the exit clutch driven members pushes upwardly on the underside of arm 132 and causes unlatching of this arm. This allows the duplex deflector 65 to rotate about one-fourth turn counterclockwise with respect to FIG. 12 back into its spring loaded normal position as shown in FIG. 3 relative to reference numeral 65. Continued counterclockwise rotation of drum 9 causes continued rotation of exit rollers 23 to remove the previously leading edge of the page away from the paper drum. Just before the previously leading edge of the page has exited past exit rollers 23, the counterclockwise rotation of drum 9 is momentarily accelerated to buckle the previously leading edge of the page out of the area of the exit rollers and duplex deflector plate.

Continued counterclockwise rotation of drum 9 causes carrier 14 and trip levers 27 and 28 (FIG. 1) to traverse to their rightmost limit. As described relative to the loading of a page out of cartridge 40, after the load trip lever 27 engages and trips the load clutch latch lever 24 the same page as previously loaded onto drum 9 is reloaded onto drum 9 with its previously trailing edge now its leading edge. It will, therefore, be understood that the side of the page previously in contact with drum 9 is now available for printing or scanning on the outside of drum 9. When this page has been loaded drum rotation is reversed to the clockwise direction relative to the right end of FIG. 1 and printing or scanning can occur as previously described.

In summary a very efficient and economical paper handling system has been provided for printing or scanning operations which requires only a single motor for loading, escapement, duplexing, and stacking a plurality of individual sheets to be printed or scanned. A leading edge of an individual page is mounted skewed relative to the axis of the drum so that continuously indexing escapement of a printing or scanning member can be coordinated with drum rotation to print or scan a series of lines parallel to a pair of oppoite edges of a rectangular page of paper. With the addition of very few additional parts beyond the basic paper handling system duplexing capability is also provided to print or scan on the opposite side of the page without the requirement for manual reloading of the page by an operator.

While the invention has been shown and described with reference to particular embodiments thereof, it will be understood by those skilled in the art that the foregoing and other changes in form and details may be made therein without departing from the spirit and scope of the invention.

We claim:

1. In a paper handling system wherein a drum, rotatable in first and second directions retains a sheet of paper for printing or scanning on a first side of said paper, said system including exit roller means for engaging an edge of said sheet exiting said drum to remove said sheet to a stacking area during a portion of rotation of said drum in said first direction, the improvement for duplexing said paper on said drum for printing on a second side of said paper, comprising:

means for interposing a duplexing deflector in a path of said paper between said drum and said stacking area for inhibiting a first edge of said paper first exiting said drum from entry into said stacking area and causing said first edge to be thereafter clamped to said drum, whereby said second side of said paper is exposed for printing or scanning;

latching means activated by rotation of said drum in said second direction after said exit roller means have engaged said paper, for activating said means for interposing said duplexing deflector; and means upon activation of said latching means and after said exit roller means have engaged said paper for causing relative movement between said drum and said exit roller means to pull said sheet of paper out of a first retention by said drum.

2. In the paper handling system of claim 1, further comprising:

means during rotation of said drum in said first direction and after said activation of said latching means for unlatching said latching means thereby removing further interpositioning of said duplexing deflector.

3. In the paper handling system of claim 2, further comprising:

feed roller means for feeding said sheet of paper for clamping to said drum.

4. In the paper handling system of claim 3, further comprising load clutch means selectively connecting said feed rollers to be rotated during rotation of said drum in said first direction for feeding said single sheet of paper toward said drum for clamping thereto.

5. In the paper handling system of claim 4, further comprising paper aligning gate means for aligning said first edge of said paper first exiting said drum in skewed relation to the axis of said drum.

6. In the paper handling system of claim 5, wherein said drum further comprises:

spring loaded clamping means for clamping an edge of said single sheet of paper for retaining said paper to said drum; and means engageable at the end of a feeding cycle, during rotation of said drum in said first direction for momentarily opening said clamping means to retain said first edge of said single sheet of paper by said drum.

* * * * *